US009702672B1

(12) United States Patent
Kim et al.

(10) Patent No.: US 9,702,672 B1
(45) Date of Patent: Jul. 11, 2017

(54) LIGHTED ARROW NOCK

(71) Applicants: Jae Woo Kim, Seongnam-si (KR); Jong Sang Lee, Seongnam-si (KR)

(72) Inventors: Jae Woo Kim, Seongnam-si (KR); Jong Sang Lee, Seongnam-si (KR)

( * ) Notice: Subject to any disclaimer, the term of this patent is extended or adjusted under 35 U.S.C. 154(b) by 0 days.

(21) Appl. No.: 15/079,588

(22) Filed: Mar. 24, 2016

(30) Foreign Application Priority Data

Mar. 7, 2016 (KR) ..... 10-2016-0026990

(51) Int. Cl.
*F42B 6/06* (2006.01)

(52) U.S. Cl.
CPC ..... *F42B 6/06* (2013.01)

(58) Field of Classification Search
CPC ..... F42B 6/04; F42B 6/06
See application file for complete search history.

(56) References Cited

U.S. PATENT DOCUMENTS 4,547,837 A * 10/1985 Bennett ..... F42B 6/06 200/60
6,736,742 B2 * 5/2004 Price ..... F42B 12/382 473/570
7,021,784 B2 * 4/2006 DiCarlo ..... F21V 33/008 362/109
7,837,580 B2 * 11/2010 Huang ..... F42B 6/06 473/570
7,931,550 B2 * 4/2011 Lynch ..... F42B 6/06 473/570
9,279,649 B2 * 3/2016 Bay ..... F42B 6/06
2016/0010961 A1 * 1/2016 Marshall, Jr. ..... F42B 12/382 473/570

* cited by examiner

*Primary Examiner* — John Ricci
(74) *Attorney, Agent, or Firm* — Cantor Colburn LLP

(57) ABSTRACT

Provided is a lighted nock for an arrow including: a light emitting part having a light coupled to the rear end periphery of a cylindrical battery, the light being turned on/off through forward and backward movements toward and from the battery; an arrow coupling part having an outer peripheral surface insertedly fitted to the rear end periphery of an arrow shaft in such a manner as to be coupled to the arrow shaft in a non-adhesive state, while having the battery inserted into the inner space thereof; and a light operating part inserted into the arrow coupling part, without being arbitrarily separated from the arrow coupling part in the state where the front end thereof grasps the light, and adapted to turn the light on/off through forward and backward movements toward and from the arrow coupling part.

8 Claims, 6 Drawing Sheets

LIGHTED ARROW NOCK

BACKGROUND OF THE INVENTION

Field of the Invention

The present invention relates to a lighted nock for an arrow, and more particularly, to a lighted nock for an arrow that is capable of turning a light on/off in a simple and accurate manner and having a stable structure in which the light is not separated from a battery while the light is being turned on/off.

Background of the Related Art

In general, an arrow 1 used for western archery includes, as illustrated in FIG. 1, an arrow shaft 10 having a cylindrical cross section made of duralumin, glass fiber, carbon fiber, or the like to form a body, an arrow head 20 fitted to the front end of the arrow shaft 10, feathers 30 designed to keep the direction of a trajectory upon flight of the arrow 1, and a nock 40 serving to lock a string thereon.

There has been recently developed a technology of providing the arrow with a light emitting function in order to enable a user to effectively enjoy games of archery even at night or on a cloudy day. In this case, a luminous light and a battery are provided to the rear end of the arrow, that is, to the nock 40, and the luminous light is turned on/off, so that the arrow has the light emitting function.

By the way, as shown in FIG. 2, the conventional arrow nock 40 with the light emitting function cannot turn a luminous light 45 on/off in an accurate manner, and further, if an excessive force is applied to the luminous light 45 during the on/off operations, the luminous light 45 may be separated from a battery 44.

SUMMARY OF THE INVENTION

Accordingly, the present invention has been made in view of the above-mentioned problems occurring in the prior art, and it is an object of the present invention to provide a lighted nock for an arrow that is capable of turning a light on/off in a simple and accurate manner and having a stable structure in which the light is not separated from a battery while the light is being turned on/off.

To accomplish the above-mentioned object, according to the present invention, there is provided a lighted nock for an arrow including: a light emitting part having a light coupled to the rear end periphery of a cylindrical battery, the light being turned on/off through forward and backward movements toward and from the battery; an arrow coupling part having an outer peripheral surface insertedly fitted to the rear end periphery of an arrow shaft in such a manner as to be coupled to the arrow shaft in a non-adhesive state, while having the battery inserted into the inner space thereof; and a light operating part inserted into the arrow coupling part, without being arbitrarily separated from the arrow coupling part in the state where the front end thereof grasps the light, and adapted to turn the light on/off through forward and backward movements toward and from the arrow coupling part.

According to the present invention, desirably, the light emitting part includes: the cylindrical battery having a fastening groove formed on the intermediate portion thereof; and the light coupled to the top end periphery of the battery in such a manner as to be turned on/off through forward and backward movements toward and from the battery.

According to the present invention, desirably, the arrow coupling part includes: an arrow coupling member having an insertion portion and a locking projection insertedly fitted to the rear end portion of the arrow shaft, the insertion portion having a battery insertion hole formed thereon to insert the battery thereinto; battery fixing members protruding inwardly from the inner periphery of the insertion portion in such a manner as to be inserted into the fastening groove of the battery in the state where the battery is inserted into the arrow coupling part so as to restrict the movement of the battery and protruding outwardly from the outer periphery of the insertion portion so as to couple the insertion portion to the rear end periphery of the arrow shaft; and a light operating part coupling member formed on the rear end periphery thereof in such a manner as to couple the light operating part thereto.

According to the present invention, desirably, the battery fixing members are formed incisedly on the different portions of the arrow coupling member from each other.

According to the present invention, desirably, the light operating part coupling member includes: a light operating part fastening hole providing a space for inserting a portion of the light operating part thereinto; movement restriction holes formed to pass through a portion of a wall body thereof in such a manner as to restrict the forward and backward movement direction and range of the light operating part; and first arrow string locking grooves engraved forwardly on the rear end periphery thereof in such a manner as to lock an arrow string thereonto.

According to the present invention, desirably, the light operating part includes: a light fixing member formed on the rear end periphery thereof in such a manner as to be inserted into the light operating part fastening hole and adapted to grasp the light so as to prevent the light at the state of being inserted thereinto from being separated therefrom; a grasping member extended from the rear end periphery of the light fixing member and adapted to restrict the insertion depth of the light fixing member into the arrow coupling part in such a manner as to be grasped by a user to operate the light; movement restriction pieces protruding outwardly from the outer peripheral surface of the grasping member and adapted to be inserted into the movement restriction holes to restrict the movement direction and range thereof in the state where the light operating part is inserted into the light operating part fastening hole; and second arrow string locking grooves engraved toward the front end periphery of the grasping member from the rear end periphery thereof to lock the arrow string thereonto.

According to the present invention, desirably, the grasping member includes grasping grooves formed on the outer peripheral surface thereof.

According to the present invention, desirably, the light fixing member includes incised portions formed on both sides facing each other.

According to the present invention, desirably, the arrow coupling part includes light out prevention wings protruding outwardly from the outer peripheral surface of the light operating part coupling member and adapted to prevent the light from being arbitrarily turned off by means of the movement of the light operating part during an arrow is shot.

BRIEF DESCRIPTION OF THE DRAWINGS

The above and other objects, features and advantages of the present invention will be apparent from the following detailed description of the preferred embodiments of the invention in conjunction with the accompanying drawings, in which.

DETAILED DESCRIPTION OF THE PREFERRED EMBODIMENTS

Hereinafter, an explanation on a lighted nock for an arrow according to the present invention will be in detail given with reference to the attached drawing.

Figure 1:
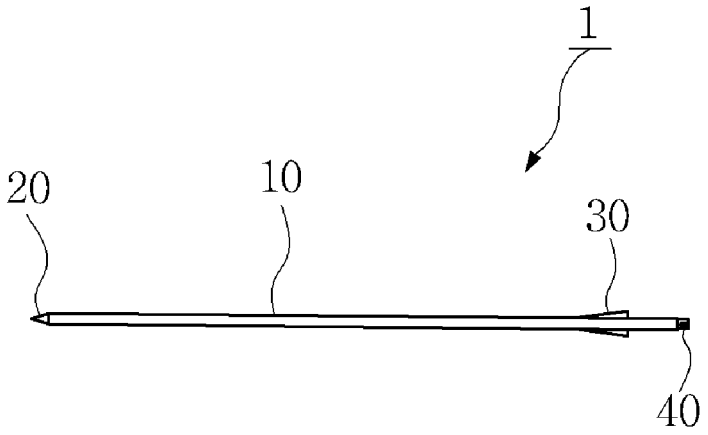
FIG. 1 Prior Art
FIG. 1 is a view showing a structure of a general arrow.
Figure 2:
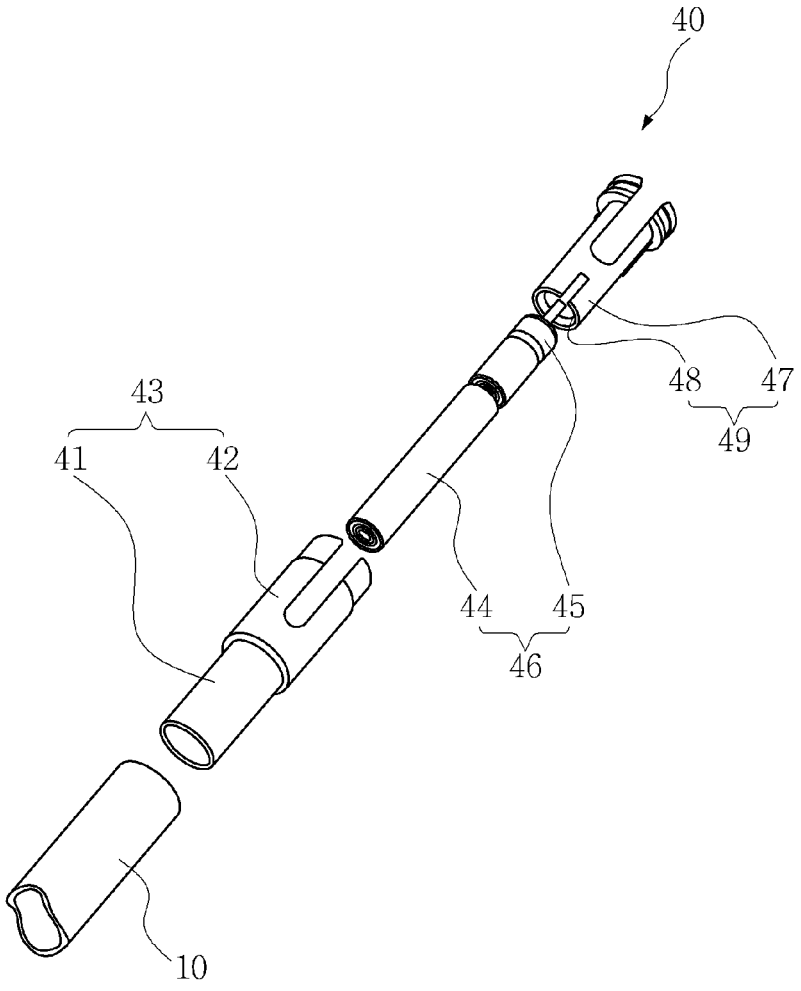
FIG. 2 Prior Art
FIG. 2 is an exploded perspective view showing a conventional lighted nock for an arrow.
Figure 3:
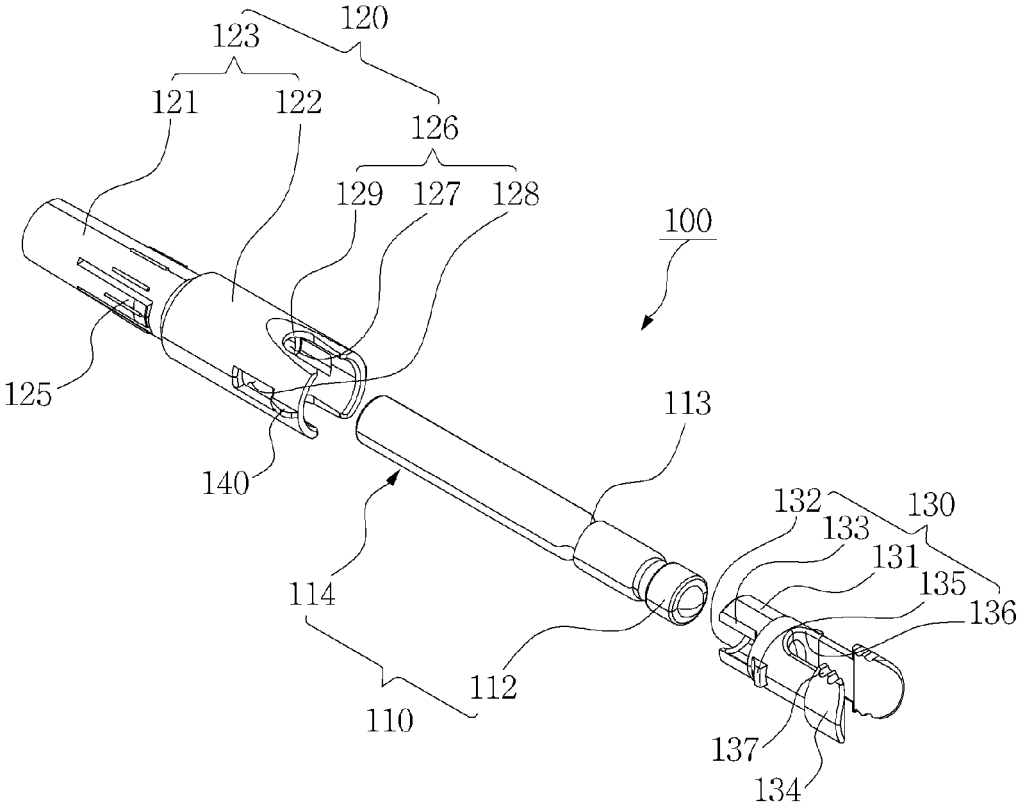
FIG. 3 is an exploded perspective view showing a lighted nock for an arrow according to the present invention.

According to the present invention, as shown in FIG. 3, a lighted nock 100 for an arrow largely includes a light emitting part 110, an arrow coupling part 120 and a light operating part 130.

First, the light emitting part 110 has a structure wherein a light 112 is coupled to the rear end periphery of a cylindrical battery 114, while serving to turn the light 112 on/off by means of forward and backward movements of the light 112 toward and from the battery 114. In more detail, the cylindrical battery 114 has a fastening groove 113 engraved on the intermediate portion thereof in such a manner as to be rigidly coupled to the arrow coupling part 120. Further, the light 112 is coupled to the rear end periphery of the battery 114 in such a manner as to be turned on/off by means of forward and backward movements toward and from the battery 114. The light 112 includes an LED module and a circuit for turning the LED module on/off.

Next, the arrow coupling part 120 has an outer peripheral surface inserted into the rear end of an arrow shaft 10 in such a manner as to be coupled to the arrow shaft 10 in a non-adhesive state, while having the battery 114 inserted into the inner space thereof. That is, the arrow coupling part 120 provides an inner space in which the light emitting part 110 and the light operating part 130 are coupled thereto so as to couple the lighted nock for an arrow 100 according to the present invention to the arrow shaft 10.

Figure 4:
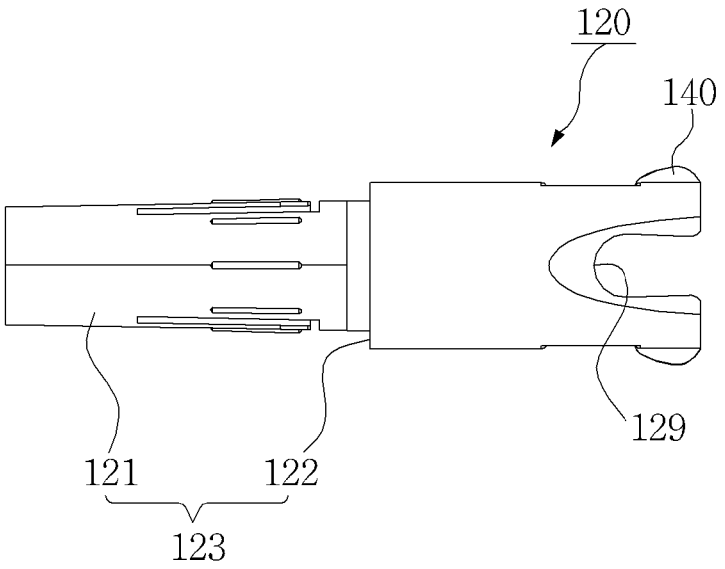
FIGS. 4 and 5 are side and perspective views showing a structure of an arrow coupling part in the lighted nock for an arrow according to the present invention.
Figure 5:
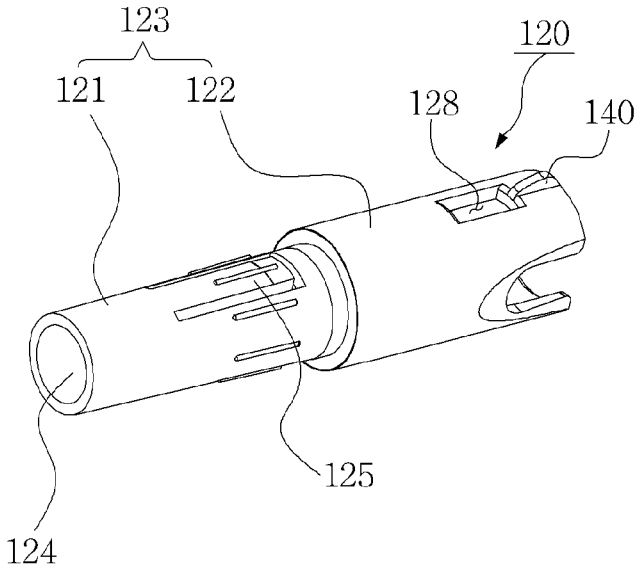

According to the present invention, as shown in FIGS. 3 to 5, the arrow coupling part 120 includes an arrow coupling member 123, battery fixing members 125 and a light operating part coupling member 126. First, as shown in FIGS. 3 to 5, the arrow coupling member 123 includes an insertion portion 121 and a locking projection 122 insertedly fitted to the rear end periphery of the arrow shaft 10, and as shown in FIG. 5, the insertion portion 121 has a battery insertion hole 124 formed to insert the battery 114 thereinto. Accordingly, the insertion portion 121 has a given diameter insertedly fitted to the rear end periphery of the arrow shaft 10, and the locking projection 122 serves as a stopper adapted to prevent the insertion portion 121 from advancing to the direction of the arrow shaft 10.

Figure 6:
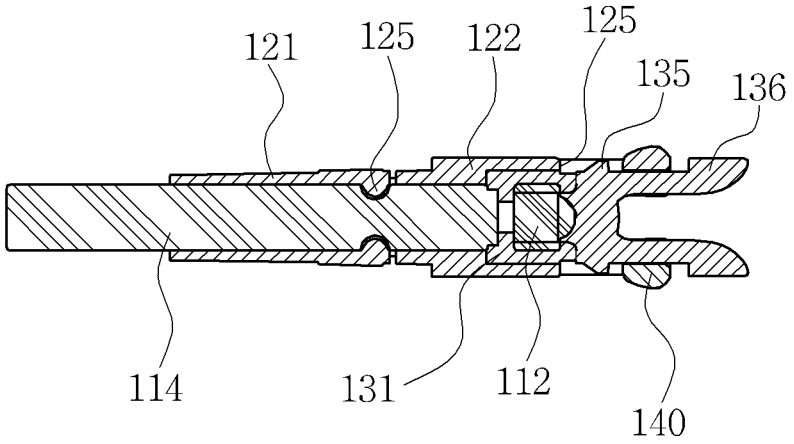
FIG. 6 is a sectional view showing a structure of the lighted nock for an arrow according to the present invention.
Figure 7:
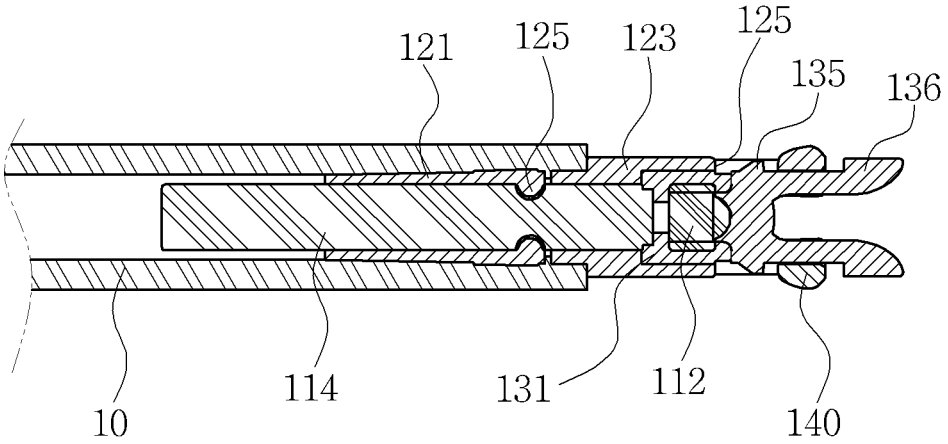
FIG. 7 is a sectional view showing a state wherein the lighted arrow neck according to the present invention is coupled to an arrow shaft.

When the battery 114 is inserted into the battery insertion hole 124, next, the battery fixing members 125 serve to rigidly couple the arrow coupling member 123 to the rear end periphery of the arrow shaft 10. In more detail, as shown in FIGS. 3 and 4, the battery fixing members 125 protrude inwardly from the inner periphery of the insertion portion 121 in such a manner as to be inserted into the fastening groove 113 of the battery 114 in the state where the battery 114 is inserted into the arrow coupling part 120 so as to restrict the movements of the battery 114. Further, as shown in FIGS. 6 and 7, the battery fixing members 125 have a higher thickness than the arrow coupling member 123 in such a manner as to protrude outwardly from the outer periphery of the insertion portion 121 in the state where the battery 114 is inserted into the arrow coupling part 120 so as to couple the insertion portion 121 to the rear end periphery of the arrow shaft 10.

According to the present invention, as shown in FIG. 5, the battery fixing members 125 are desirably formed incisedly on the different portions of the arrow coupling member 123 so that they easily protrude outwardly in the state where the battery 114 is inserted into the insertion portion 121.

Next, as shown in FIG. 3, the light operating part coupling member 126 is formed on the rear end periphery of the arrow coupling part 120 in such a manner as to couple the light operating part 130 thereto. In more detail, as shown in FIG. 3, the light operating part coupling member 126 includes a light operating part fastening hole 127, movement restriction holes 128, and first arrow string locking grooves 129. The light operating part fastening hole 127 provides a space in which a portion of the light operating part 130 is inserted and is open on the rear end periphery thereof in such a manner as to insert the light operating part 130 thereinto.

Further, as shown in FIG. 3, the movement restriction holes 128 have a shape of a long rectangle formed to pass through a portion of a wall body of the light operating part coupling member 126 and serve to restrict the forward and backward movement direction and range of the light operating part 130. The formation of the movement restriction holes 128 enables the forward and backward movement ranges and directions of movement restriction pieces 135 as will be discussed later to be restricted.

Next, the first arrow string locking grooves 129 are engraved forwardly on the rear end periphery of the light operating part coupling member 126 and serve to lock the arrow string thereonto. The first arrow string locking grooves 129 are desirably formed to avoid the positions in which the movement restriction holes 128 are formed.

Next, as shown in FIG. 7, the light operating part 130 is coupled to the rear end periphery of the arrow coupling part 120 to turn the light 112 on/off. That is, the light operating part 130 is movable forwardly and backwardly in the state of being coupled to the arrow coupling part 120, while being not arbitrarily separated from the arrow coupling part 120. In this state, the front end periphery of the light operating part 130 grasps the light 112 of the light emitting part 110 fixed to the arrow coupling part 120. While the light operating part 130 is moving forwardly and backwardly, accordingly, it moves the light 112 forwardly and backwardly toward and from the battery 114. Through the forward and backward operations of the light operating part 130, the light 112 moves forwardly and backwardly toward and from the battery 114, so that the light 112 is turned on/off.

According to the present invention, as shown in FIG. 3, the light operating part 130 includes a light fixing member 131, a grasping member 134, the movement restriction pieces 135, and second arrow string locking grooves 136. First, as shown in FIGS. 3 and 7, the light fixing member 131 is formed on the rear end periphery of the light operating part 130 in such a manner as to be inserted into the light operating part fastening hole 127, and further, serves to grasp the light 112 so as to prevent the light 112 at the state of being inserted thereinto from being separated therefrom. Accordingly, if the light operating part 130 is coupled to the arrow coupling part 120 in the state wherein the light emitting part 110 is first fixedly coupled to the arrow coupling part 120, the light fixing member 131 grasps the fixed light 112, and thus, the light 112 and the light operating part 130 are coupled to each other.

At this time, the light fixing member 131 has light grasping grooves for inserting the light 112 thereinto and a light locking projection 132 for locking the lower end periphery of the light 112 thereonto. Further, as shown in FIG. 3, the light fixing member 131 includes incised portions 133 formed on both sides facing each other to easily insert the light 112 thereinto and further to easily manufacture the light operating part 130.

Next, as shown in FIG. 3, the grasping member 134 is extended from the rear end periphery of the light fixing member 131 and serves to restrict the insertion depth of the light fixing member 131 into the arrow coupling part 120 in such a manner as to be grasped by a user to operate the light 112. Accordingly, the grasping member 134 has a larger diameter than other portions of the light operating part 130 so that it cannot be inserted into the light operating part fastening hole 127 of the arrow coupling part 120. Further, as shown in FIG. 7, the grasping member 134 is kept exposed to the outside in the state where the light operating part 130 is coupled to the arrow coupling part 120. Accordingly, the grasping member 134 can be grasped easily by means of the user so as to operate the light operating part 130.

Of course, as shown in FIG. 3, the grasping member 134 desirably includes grasping grooves 137 formed on the outer peripheral surface thereof so as to improve frictional and grip forces while the light operating part 130 is being grasped and moved by the user.

Next, as shown in FIG. 3, the movement restriction pieces 135 protrude outwardly from the outer peripheral surface of the grasping member 134, and as shown in FIG. 7, they are inserted into the movement restriction holes 128 to restrict the movement direction and range of the light operating part 130 in the state where the light operating part 130 is inserted into the light operating part fastening hole 127. That is, since the movement restriction pieces 135 are moved only in the state of being inserted into the movement restriction holes 128, the movement direction of the light operating part 130 is restricted in the longitudinal direction of the arrow coupling part 120, and the movement range thereof is restricted within the lengths of the movement restriction holes 128.

On the other hand, the movement restriction pieces 135 desirably have slant lower peripheral surfaces so that they can easily enter the arrow coupling part 120 at the time when they are initially coupled to the arrow coupling part 120. Further, the movement restriction pieces 135 desirably have vertical upper peripheral surfaces so that while being operated, they cannot be arbitrarily escaped from the movement restriction holes 128.

In this case, the arbitrary escape means that the light operating part 130 is escaped arbitrarily from the arrow coupling part 120, irrespective of the user's intention, except that the light operating part 130 is intentionally separated from the arrow coupling part 120 so as to exchange the battery 114 into new one.

Next, as shown in FIG. 3, the second arrow string locking grooves 136 are engraved toward the front end periphery of the grasping member 134 from the rear end periphery thereof to lock the arrow string thereonto. Accordingly, as shown in FIGS. 8 and 9, the second arrow string locking grooves 136 are formed in the direction corresponding to the first arrow string locking grooves 129 in the state where the light operating part 130 is coupled to the arrow coupling part 120.

Next, as shown in FIG. 3, the arrow coupling part 120 desirably includes light out prevention wings 140. The light out prevention wings 140 protrude outwardly from the outer peripheral surface of the light operating part coupling member 126 and serve to prevent the light 112 from being arbitrarily turned off by means of the movement of the light operating part 130 during the arrow is shot. According to the present invention, the lighted nock for an arrow 100 is shot, while touching lightly a bow. If there are no light out prevention wings 40, accordingly, the grasping member 134 is locked onto the bow and thus moved backwardly to cause the light 112 to be automatically turned off. Accordingly, the formation of the light out prevention wings 140 basically prevents the grasping member 134 from being touched with the bow.

Now, an explanation on the operations of the lighted nock 100 for an arrow according to the present invention will be given.

Figure 8:
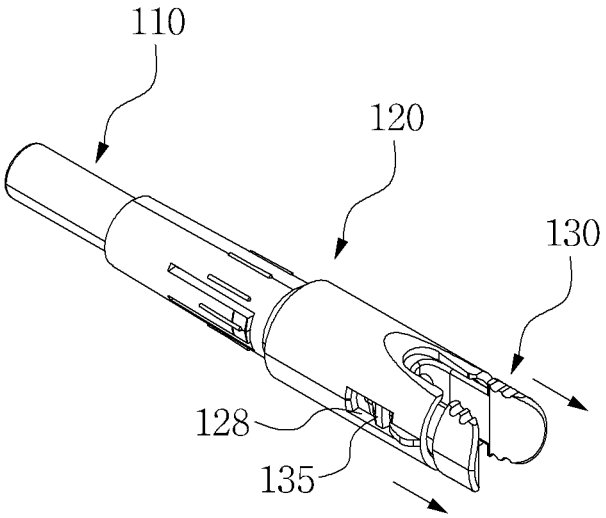
FIGS. 8 and 9 are perspective views showing the operating states of the lighted nock for an arrow according to the present invention.
Figure 9:
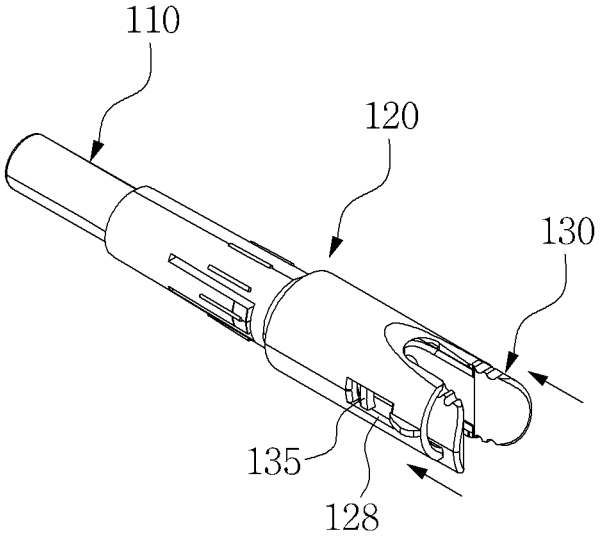

First, as shown in FIG. 8, if the light operating part 130 coupled to the arrow coupling part 120 pulls, it moves within the movement ranges of the movement restriction pieces 135. As a result, the light 112 pulls out by means of the light fixing member 131 so that it is distant from the battery 114 and then turned off.

Further, as shown in FIG. 9, if the light operating part 130 is pressurized toward the arrow coupling part 120 by means of an external force, it moves to the arrow coupling part 120 so that the light fixing member 131 pushes the light 112 toward the battery 114, thus turning the light 112 on. Of course, turning on the light 112 is conducted when the arrow string pulls in the state where the arrow is loaded on the bow.

As described above, the lighted nock for an arrow according to the present invention can turn the light on/off through simple pressing and pulling operations of the light operating part, thus making it easy to use. Further, the lighted nock for an arrow according to the present invention is configured to have the arrow coupling part and the light operating part coupled to each other, so that it can be rigidly coupled to the arrow shaft, without having any adhesive, and the light can operate easily.

Additionally, the lighted nock for an arrow according to the present invention can accurately restrict the movement range and direction of the light operating part, thus preventing the occurrence of malfunctions or separation of the light while operated.

While the present invention has been described with reference to the particular illustrative embodiments, it is not to be restricted by the embodiments but only by the appended claims. It is to be appreciated that those skilled in the art can change or modify the embodiments without departing from the scope and spirit of the present invention.

What is claimed is:

1. A lighted nock for an arrow, comprising:

a light emitting part having a light coupled to the rear end periphery of a cylindrical battery, the light being turned on/off through forward and backward movements toward and from the battery;

an arrow coupling part having an outer peripheral surface insertedly fitted to the rear end periphery of an arrow shaft in such a manner as to be coupled to the arrow shaft in a non-adhesive state, while having the battery inserted into the inner space thereof; and a light operating part inserted into the arrow coupling part, without being arbitrarily separated from the arrow coupling part in the state where the front end thereof grasps the light, and adapted to turn the light on/off through forward and backward movements toward and from the arrow coupling part, wherein the light emitting part comprises:

the cylindrical battery having a fastening groove formed on the intermediate portion thereof; and the light coupled to the top end periphery of the battery in such a manner as to be turned on/off through forward and backward movements toward and from the battery.

2. The lighted nock for an arrow according to claim 1, wherein the arrow coupling part comprises:

an arrow coupling member having an insertion portion and a locking projection insertedly fitted to the rear end portion of the arrow shaft, the insertion portion having a battery insertion hole formed thereon to insert the battery thereinto;

battery fixing members protruding inwardly from the inner periphery of the insertion portion in such a manner as to be inserted into the fastening groove of the battery in the state where the battery is inserted into the arrow coupling part so as to restrict the movements of the battery and protruding outwardly from the outer periphery of the insertion portion so as to couple the insertion portion to the rear end periphery of the arrow shaft; and a light operating part coupling member formed on the rear end periphery thereof in such a manner as to couple the light operating part thereto.

3. The lighted nock for an arrow according to claim 2, wherein the battery fixing members are formed incisedly on the different portions of the arrow coupling member from each other.

4. The lighted nock for an arrow according to claim 2, wherein the light operating part coupling member comprises:

a light operating part fastening hole providing a space for inserting a portion of the light operating part thereinto;

movement restriction holes formed to pass through a portion of a wall body thereof in such a manner as to restrict the forward and backward movement direction and range of the light operating part; and first arrow string locking grooves engraved forwardly on the rear end periphery thereof in such a manner as to lock an arrow string thereonto.

5. The lighted nock for an arrow according to claim 4, wherein the light operating part comprises:

a light fixing member formed on the rear end periphery thereof in such a manner as to be inserted into the light operating part fastening hole and adapted to grasp the light so as to prevent the light at the state of being inserted thereinto from being separated therefrom;

a grasping member extended from the rear end periphery of the light fixing member and adapted to restrict the insertion depth of the light fixing member into the arrow coupling part in such a manner as to be grasped by a user to operate the light;

movement restriction pieces protruding outwardly from the outer peripheral surface of the grasping member and adapted to be inserted into the movement restriction holes to restrict the movement direction and range of the light operating part in the state where the light operating part is inserted into the light operating part fastening hole; and second arrow string locking grooves engraved toward the front end periphery of the grasping member from the rear end periphery thereof to lock the arrow string thereonto.

6. The lighted nock for an arrow according to claim 5, wherein the grasping member comprises grasping grooves formed on the outer peripheral surface thereof.

7. The lighted nock for an arrow according to claim 5, wherein the light fixing member comprises incised portions formed on both sides facing each other.

8. The lighted nock for an arrow according to claim 2, wherein the arrow coupling part comprises light out prevention wings protruding outwardly from the outer peripheral surface of the light operating part coupling member and adapted to prevent the light from being arbitrarily turned off by means of the movement of the light operating part during an arrow is shot.

* * * * *